US007969321B2

(12) United States Patent
Spellman

(10) Patent No.: US 7,969,321 B2
(45) Date of Patent: Jun. 28, 2011

(54) SMOKE DETECTOR

(76) Inventor: John Spellman, East Sydney (AU)

( * ) Notice: Subject to any disclaimer, the term of this patent is extended or adjusted under 35 U.S.C. 154(b) by 1194 days.

(21) Appl. No.: 11/571,078

(22) PCT Filed: Jun. 20, 2005

(86) PCT No.: PCT/AU2005/000872

§ 371 (c)(1),
(2), (4) Date: Dec. 21, 2006

(87) PCT Pub. No.: WO2005/124710

PCT Pub. Date: Dec. 29, 2005

(65) Prior Publication Data

US 2008/0272922 A1 Nov. 6, 2008

(30) Foreign Application Priority Data

Jun. 21, 2004 (AU) ..... 2004903381

(51) Int. Cl.

| | |
|---|---|
| ***G08B 23/00*** | (2006.01) |
| ***G08B 17/10*** | (2006.01) |
| ***B42F 13/00*** | (2006.01) |
| *F21S 8/00* | (2006.01) |

(52) U.S. Cl. ..... 340/693.6; 340/693.5; 340/693.9; 340/693.11; 340/628; 248/343; 362/147; 362/404

(58) Field of Classification Search ..... 340/693.6, 340/693.5, 693.9, 693.11
See application file for complete search history.

(56) References Cited

U.S. PATENT DOCUMENTS

| | | | | |
|---|---|---|---|---|
| 3,327,984 | A * | 6/1967 | Rennie | 248/343 |
| 4,090,178 | A * | 5/1978 | Norris | 340/506 |
| 4,812,827 | A * | 3/1989 | Scripps | 340/693.1 |
| 5,315,292 | A | 5/1994 | Prior | |
| 5,333,418 | A | 8/1994 | Chambers | |
| 5,555,455 | A * | 9/1996 | McGinley | 340/627 |
| 6,226,939 | B1 * | 5/2001 | Atkins et al. | 52/232 |

FOREIGN PATENT DOCUMENTS

EP 1 039 426 A2 9/2000

* cited by examiner

*Primary Examiner* — Donnie L Crosland
(74) *Attorney, Agent, or Firm* — Brooks Kushman P.C.

(57) ABSTRACT

A smoke detector adapted for installation within a bracket of a ceiling downlight; the smoke detector comprising a lower body portion adapted for engagement with said bracket, and an upper body portion extending upwardly from said lower portion.

21 Claims, 5 Drawing Sheets

SMOKE DETECTOR

The present invention relates to smoke detectors and, more particularly, to smoke detectors and mounting fixtures and methods therefor.

BACKGROUND

In many jurisdictions it is now a requirement that new buildings, both domestic and commercial, be fitted with smoke detectors. Typically, these devices are housed in a generally plastic enclosure and attached to ceilings in strategic locations within the building.

Although not large, such devices by their bulk, colour and projection below the plane of the ceiling to which they are attached, produce a jarring detraction from the aesthetics of the room in which they are positioned. For this reason, there is a tendency to locate such detectors in a least intrusive position, rather than the optimum position for detection, which generally speaking, is central to the room.

It is an object of the present invention to address or at least ameliorate some of the above disadvantages.

BRIEF DESCRIPTION OF INVENTION

Accordingly, in a first broad form of the invention, there is provided a smoke detector adapted for installation within a bracket of a ceiling downlight; said smoke detector comprising a lower body portion adapted for engagement with said bracket, and an upper body portion extending upwardly from said lower portion.

Preferably, said lower body portion is of similar shape to that of a light source adapted for retention in said bracket.

Preferably, said lower body portion is of a generally truncated parabolic form closed at a wider lower end with a disc-shaped front face portion.

Preferably, said bracket is adapted for insertion into a hole cut into a ceiling.

Preferably, said bracket has a central aperture for receiving therein said light source.

Preferably, said bracket is provided with a retaining arrangement for securing said light source within said bracket; said retaining arrangement securing said detector when said bracket is used for mounting of said detector.

Preferably, said retaining arrangement comprises a retaining ring releasably held in said bracket; said front face portion of said smoke detector locating in said ring.

Preferably, said retaining arrangement comprises at least one spring clip.

Preferably, said upper body portion is of generally cylindrical shape with a diameter not exceeding the diameter of said front face portion.

Preferably, combined volume of said lower body portion and said upper body portion is sufficient to retain therein working components of said smoke detector.

Preferably, said front face portion is provided with at least one grille for ingress of air and smoke into said lower body portion.

Preferably, said front face portion is further provided with a reset/test button.

Preferably, said front face portion is further provided with an indicator light.

Preferably, said front face portion is of a substantially transparent material.

Preferably, said lower body portion is provided with a light emitter adapted to emit light through said substantially transparent material.

In a further broad form of the invention, there is provided a smoke detector adapted for substantially flush fitting within an aperture in a ceiling; said detector comprising a detector body and a mounting bracket; said mounting bracket arranged to be of similar appearance to brackets of flush-mounted downlights.

Preferably, said detector body is retained in said bracket so as to be wholly above a surface of said ceiling.

Preferably, said bracket is arranged for retained insertion into said aperture provided in said ceiling.

Preferably, said detector body and said bracket are provided with mating elements arranged to allow releasable retention of said detector body in said bracket.

In still a further broad form of the invention, there is provided a method for installing a smoke detector substantially flush with the surface of a ceiling; said smoke detector not projecting substantially below said surface; said method including the steps of:

(a) cutting a hole in a ceiling for insertion of a downlight bracket, (b) installing a power supply and any required interconnecting cabling, (c) installing said retaining bracket into said hole, (d) connecting said power supply and any said cabling to said smoke detector, (e) fitting said smoke detector to said bracket.

Preferably, said smoke detector comprises a body having a lower portion shaped to conform to at least a portion of a light source intended for said bracket.

Preferably, said bracket is adapted to releasably retain said smoke detector within said bracket.

BRIEF DESCRIPTION OF THE DRAWINGS

Embodiments of the present invention will now be described with reference to the accompanying drawings wherein.

DETAILED DESCRIPTION OF PREFERRED EMBODIMENTS

Figure 1:
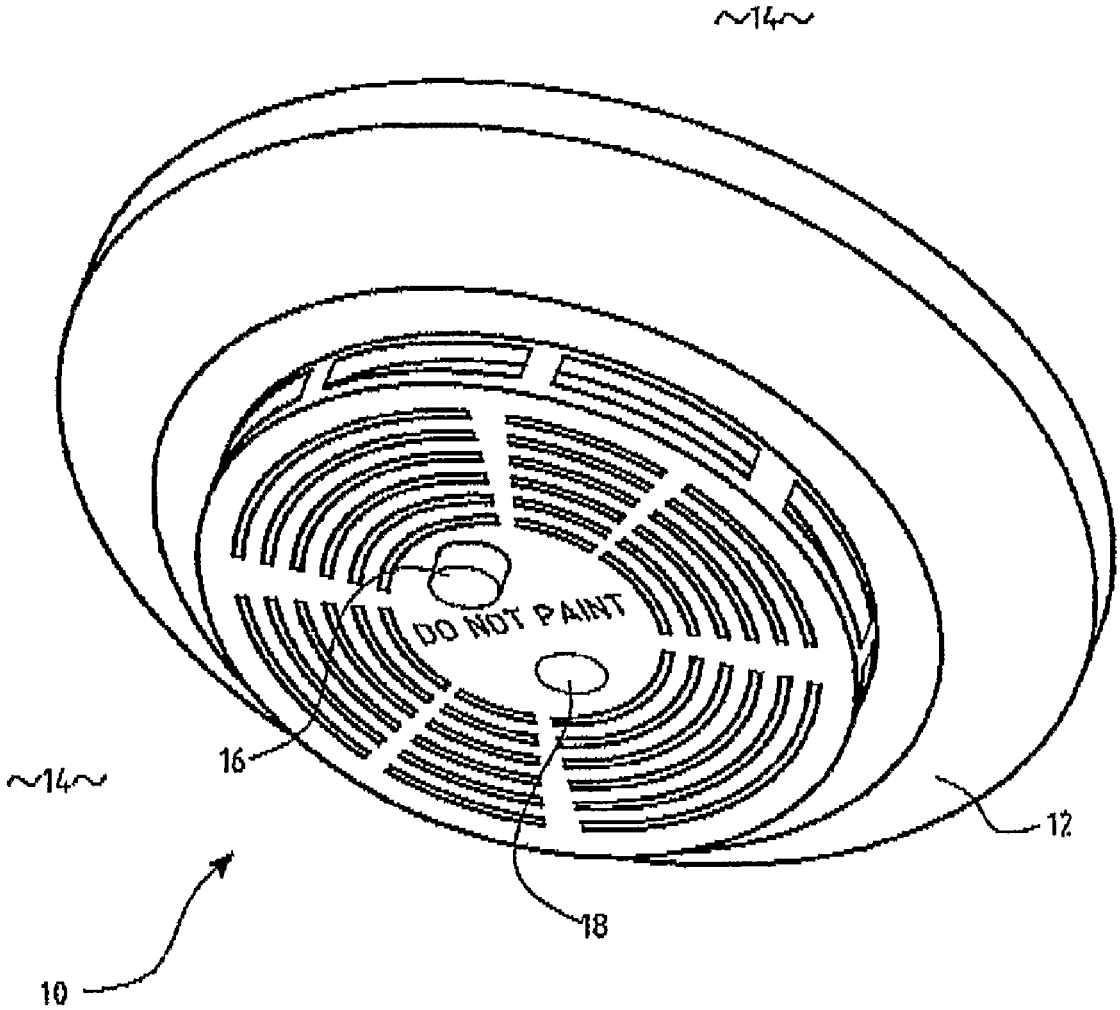
Fig. 1 (Prior Art)
FIG. 1 is a perspective view of a typical smoke detector according to prior art mounted to a ceiling surface.

With reference to FIG. 1 a typical smoke detector 10 according to the prior art is enclosed in a body 12 affixed to the surface 14 of a ceiling. Such smoke detectors may be battery operated where they are retrofitted in older buildings but must be wired to a power supply in new buildings where appropriate regulations and building codes apply. They may also need to be interconnected so that if one alarm is triggered in one part of a building, all other alarms will also sound.

Smoke detectors for most commercial and domestic installations operate on the principle of a radioactive source ionizing air in the detector and passing a current through that air across a small gap. The presence of smoke reduces the conductivity across the gap, setting off an alarm. Other methods of smoke detection make use of photoelectric technology to sense the presence of smoke.

Smoke detectors generally include a reset/test button 16 which may be used to silence the alarm if the device is triggered by an other than dangerous smoke situation and for confirming the alarm is in working order. Smoke detectors are further equipped with an indicator light 18 to confirm that the detection circuit is in working order and a grille or grating to allow air and smoke to enter the inside of the body of the detector. A second grille 65 may be provided for the alarm sound to pass through. In at least some jurisdictions, smoke detectors must display a warning that the detector must not be painted.

The actual components which make up the detector, that is the sensing circuitry, alarm sound generator and power supply module may be housed in any desired shape of enclosure. The power supply module may also be located in a separate housing in proximity to the sensing and alarm enclosure.

The smoke detector of the present invention utilizes the standard brackets of readily available downlights. The term "downlight" as used in this specification refers to a ceiling mounted light comprising a light source retained in a bracket, the visible portion of which is a surrounding frame projecting only slightly below the surface of the ceiling, all other parts of the downlight, including the retaining parts of the bracket, projecting up into a hole cut into the ceiling.

The term "light source" as used in this specification comprises an integral assembly of a generally parabolic reflector, a transparent lens, power connections and a globe; the assembly adapted for fitting into the substantially flush mounting bracket of the downlight. It may further refer to a reflector and globe only; that is, an assembly without a lens.

First Preferred Embodiment

Figure 2:
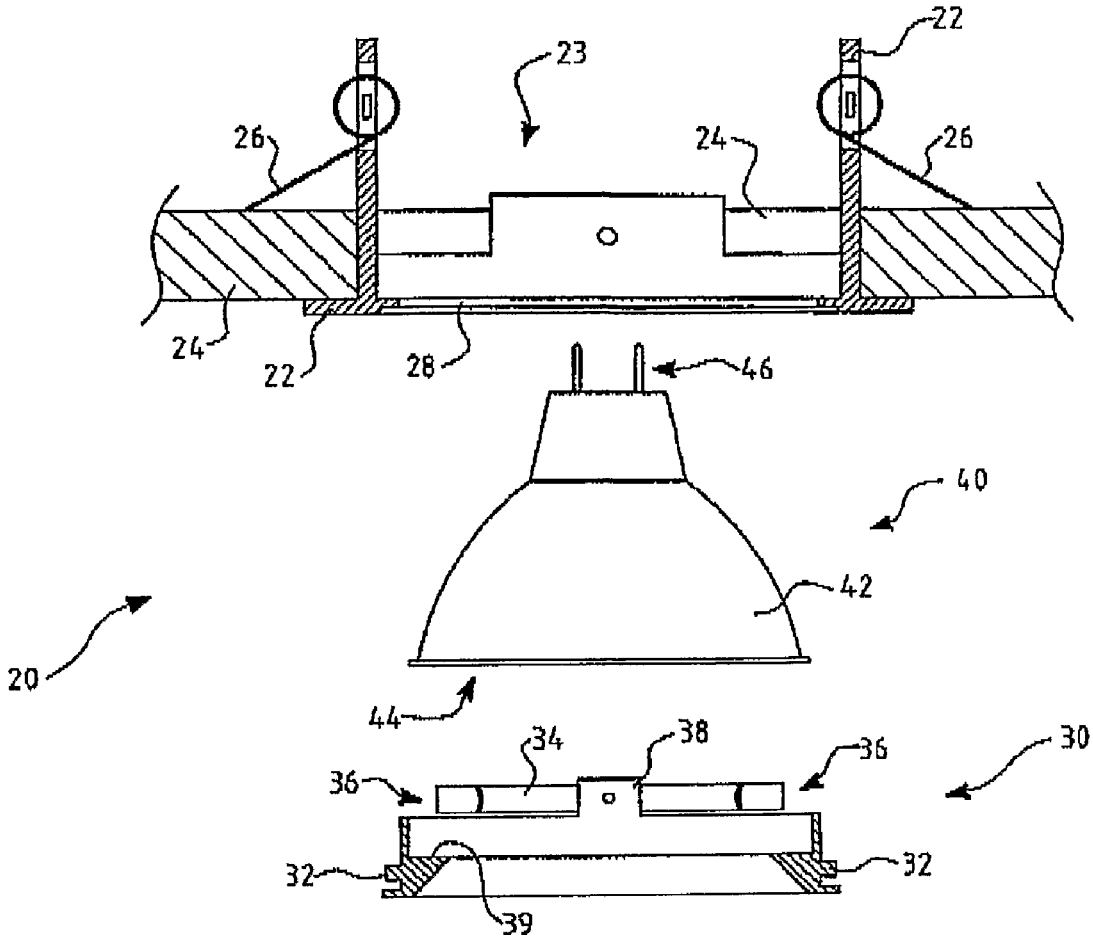
FIG. 2 is an exploded partially sectioned elevation view of the support components of a typical downlight bracket and light source with the main support component fitted to hole cut into a ceiling panel.

FIG. 2 shows a bracket assembly 20 typically used for installation of a standard halogen downlight into paneling or sheeting of a ceiling. Although the following examples of embodiments of the invention are with reference to a diachronic or halogen downlight and its fittings, it will be appreciated that the principles described may be applied to any fittings for downlights substantially flush mounted to a ceiling surface.

In the example of FIG. 2, bracket 22 is inserted into a hole 23 cut into the ceiling 24 and retained therein by spring clips 26. A retainer ring 30 is adapted for releasable insertion into bracket 22 by means of retainer lugs 32 which pass through diametrically opposed gaps (not shown) in annular ledge 28 of bracket 22 in the manner of a bayonet fitting.

Figure 3:
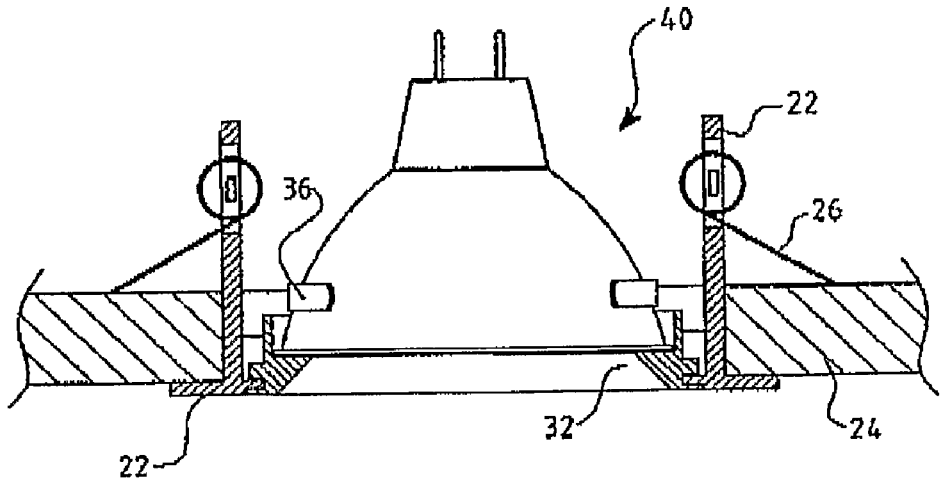
FIG. 3 is a view of the components of FIG. 2 when assembled.

Retainer ring 30 is provided with a spring clip 34 forming a pair of arcuate arms 36 extending from support member 38. Arms 36 are adapted to partially encircle and hold a light source 40 onto annular ledge 39. Light source 40, as described above, comprises an integral assembly of a generally parabolic reflector 42, a transparent lens 44, power connections 46 and a halogen globe (not shown). The bracket 22, retainer ring 30 and light source 40 are shown assembled in FIG. 3.

With reference to FIGS. 4 to 7, a smoke detector 50 according to a preferred embodiment of the invention, has a body 52 with a lower portion 54 of similar shape to that of the light source reflector 42 previously described. The front face 55 of the detector is of the same diameter as the lens 44.

Figure 4:
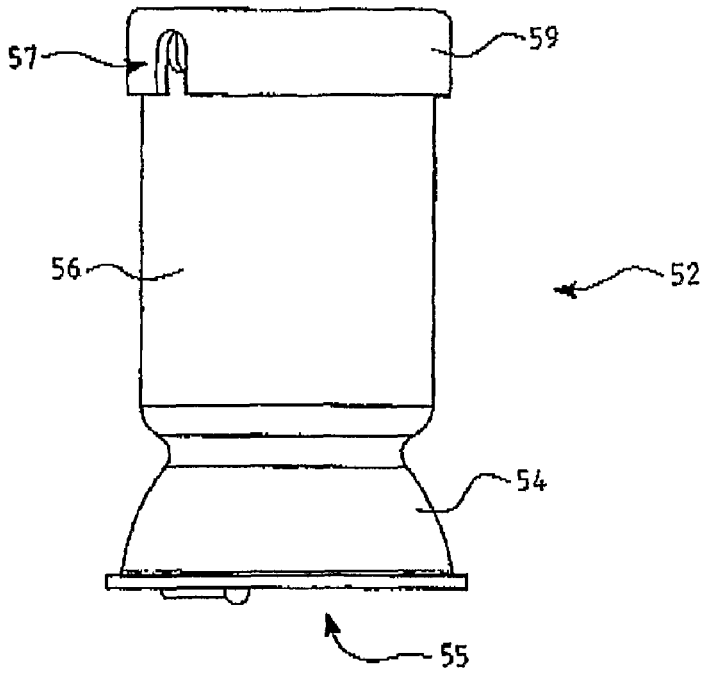
FIG. 4 is a side elevation view of a smoke detector according to a preferred embodiment of the invention

Although shown in FIG. 4 as of truncated parabolic form, it will be clear that an approximating conic section able to be gripped by the arms 36 of spring clip 34 will be equally suitable for lower portion 54. Indeed, the smoke detector of the present invention may have its lower body portion adapted for mounting into any standard downlight fitting.

The upper portion 56 of body 52 is preferably cylindrical and the junction with lower body 54 shaped so as not to interfere with the holding arrangement of the light source, such as spring clip 34. The maximum diameter of upper body 56 is not greater than that of the lens 44 of the light source for which the bracket is intended, so that the whole of the detector may be removed or inserted into the bracket 22 in a similar manner to that of a light source. The volume of the combined lower and upper portions 54 and 56 is sufficient to accommodate the working elements of the smoke detector. The power supply (not shown) and any interconnections with other smoke detectors within a building are connected via a plug-in socket 57 in end cap 59.

Figure 5:
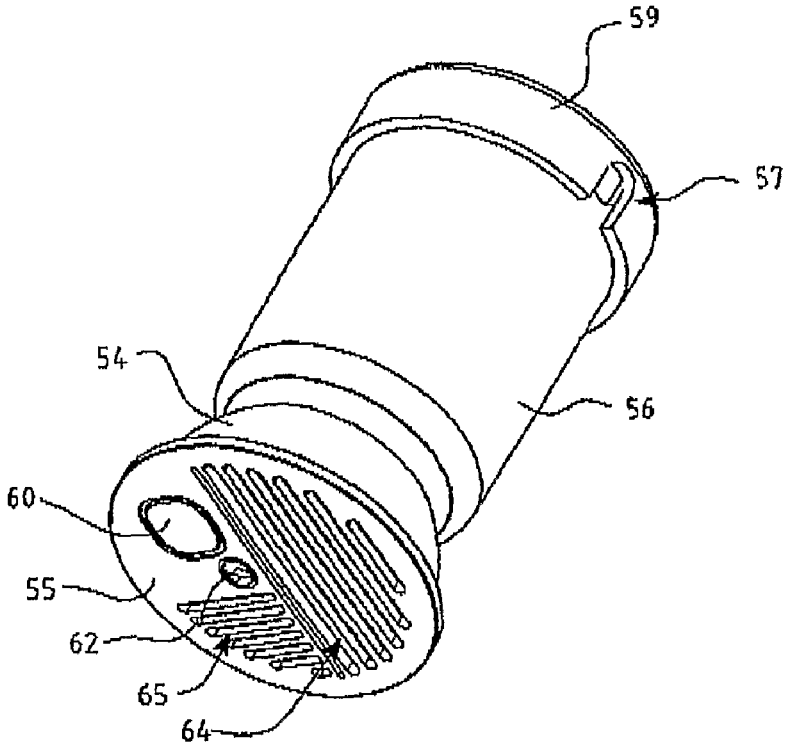
FIG. 5 is a perspective view of the smoke detector of FIG. 4.
Figure 6:
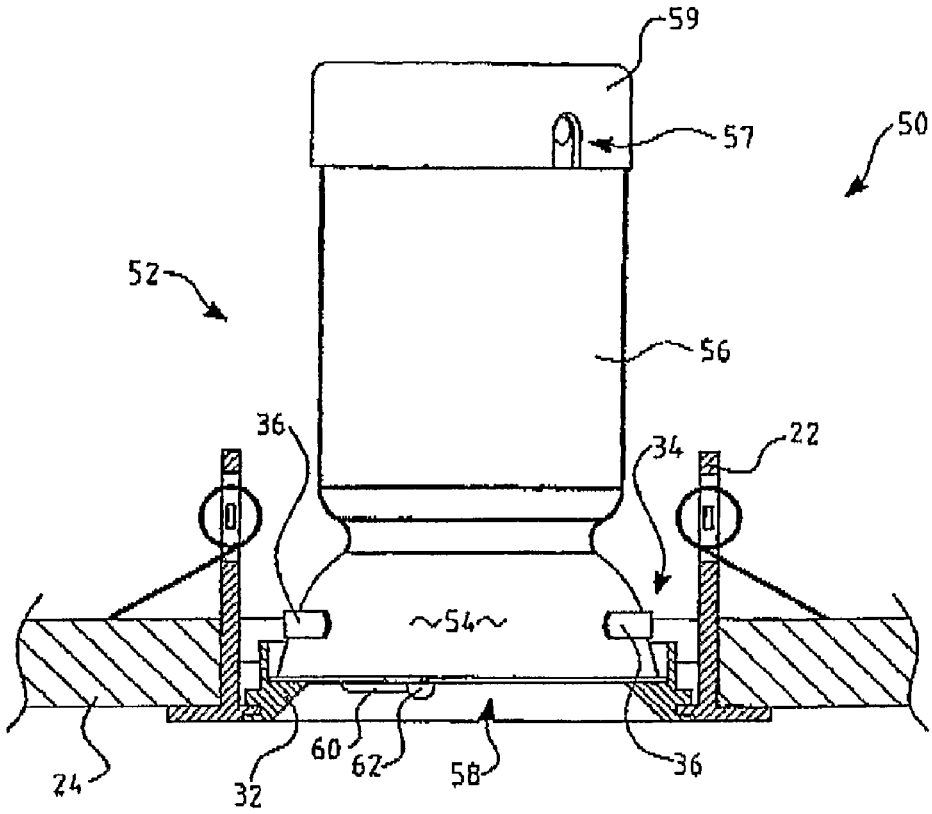
FIG. 6 is a partially sectioned elevation view of a preferred embodiment of a smoke detector according to the invention mounted in the support components of FIGS. 2 and 3.
Figure 7:
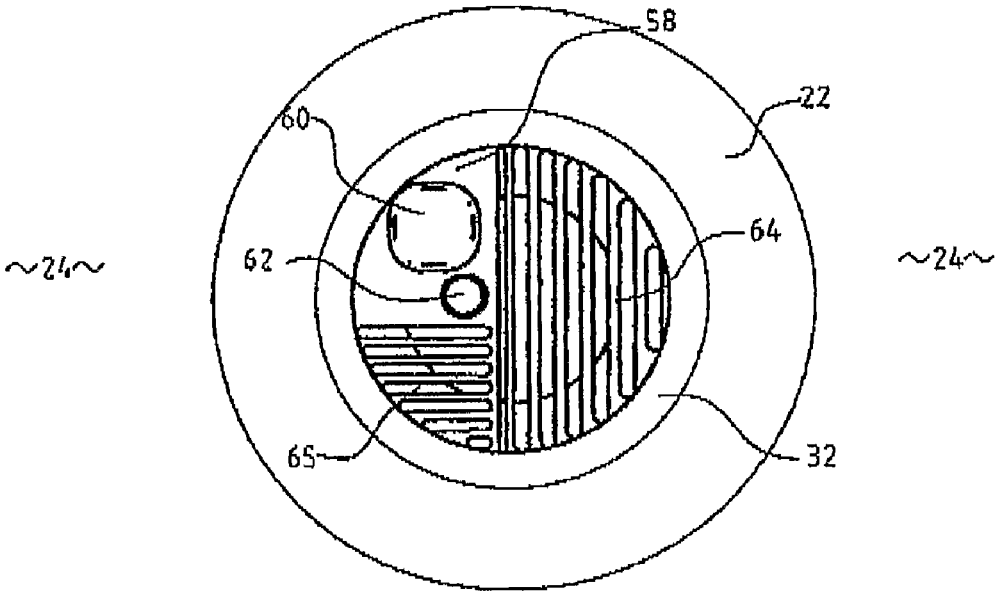
FIG. 7 is a view from below of the smoke detector of FIG. 4 as fitted to the support components of FIGS. 2 and 3.

The front face 55 of the smoke detector, which is analogous to the lens of the light source, is substantially in the form of a disc 58 in which is located a reset button 60, indicator light 62, an air and smoke entry grille 64 and an alarm sound emitting grille 65, as best seen in FIGS. 5 and 7.

Where the detection or light source technologies permit, disc 58 may be transparent and a light emitter fitted behind the disc. The smoke detector may then also serve as a downlight, thus blending in with similarly installed downlights in a room when the lights are switched on.

Figure 8:
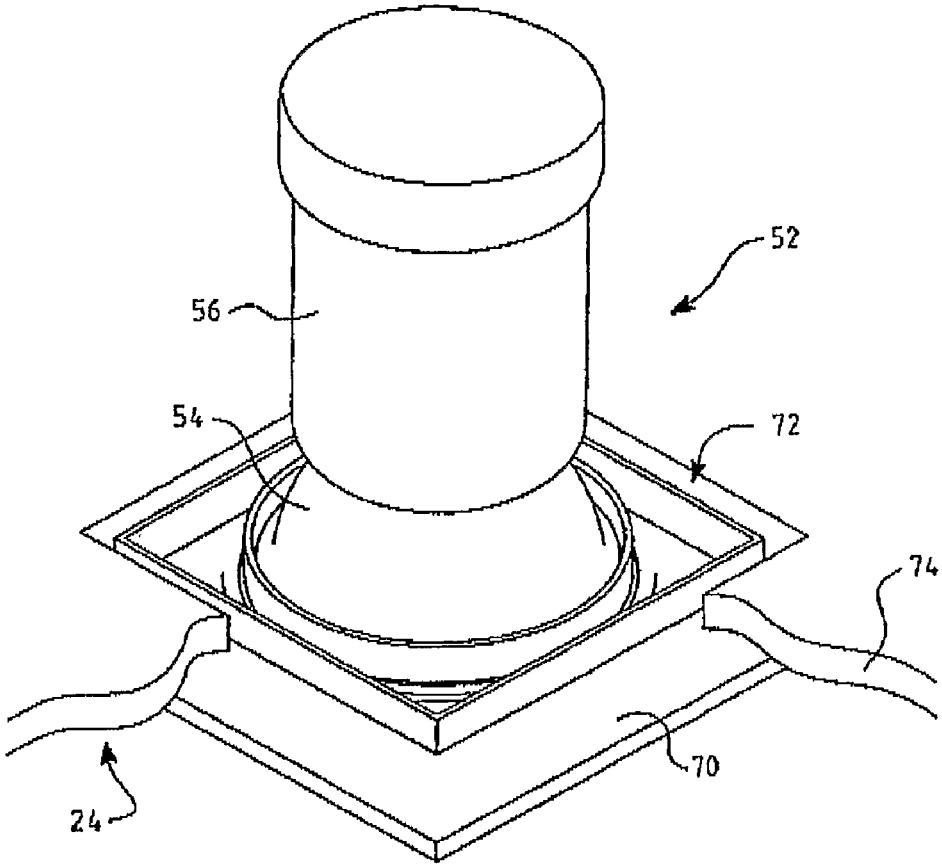
FIG. 8 is a view of a the smoke detector of FIGS. 4 and 5 fitted to a square downlight bracket mounted in a ceiling.
Figure 9:
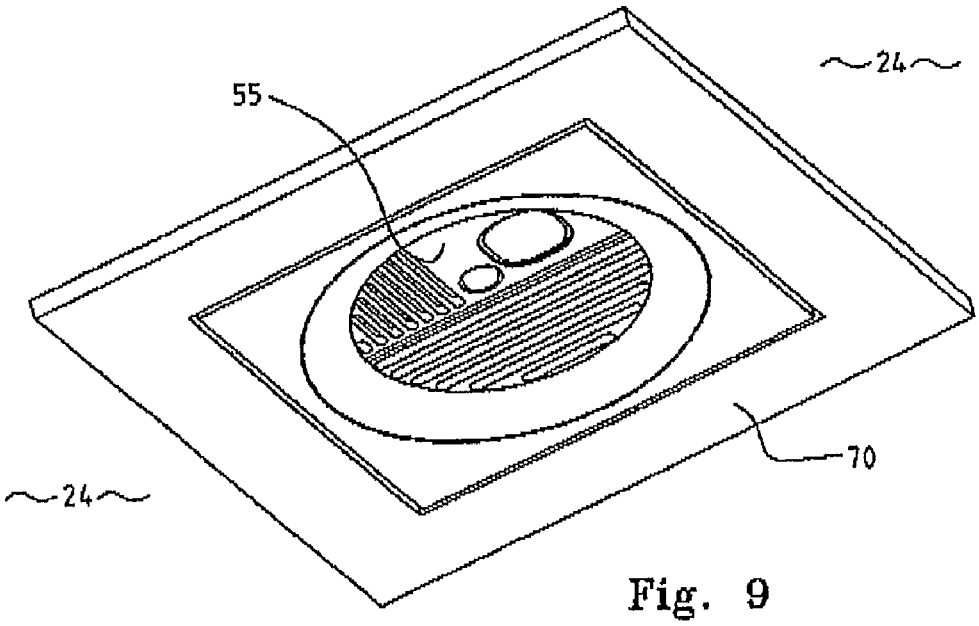
FIG. 9 is a view of the smoke detector front panel and mounting bracket of FIG. 8 viewed from underneath a ceiling.

FIG. 8 shows the smoke detector 52 mounted in a square downlight bracket 70 inserted into a hole 72 cut into ceiling sheet 74. The appearance as seen from inside a room in which the detector 52 and bracket 70 are installed is shown in FIG. 9.

Further Preferred Embodiments

In a second preferred embodiment of the invention, the lower portion of the body of a smoke detector may incorporate the features of retaining ring 30 so as to be capable of fitting directly into the bracket 22.

In still a further embodiment of the invention the smoke detector may be supplied complete with its own bracket for fitting to a hole cut into a ceiling, the bracket being made available in a number of styles and finishes to match those of the downlights with which the smoke detector is to be installed. Alternatively, the chosen bracket may such as to distinguish the detector from the downlights making it easily locatable, but yet not be visually intrusive in the manner of detectors mounted below the ceiling surface.

In Use

The installation of a smoke detector of the present invention involves the following steps;

(a) select a suitable bracket, either identical to brackets of downlights (if any) in the room in which the smoke detector is to be located, or otherwise satisfying aesthetic considerations, (b) cut a hole in the ceiling at the selected location for the detector bracket, (c) install power supply and interconnecting cabling as required within the ceiling space, (d) install the bracket, (e) connect power and any interconnecting cabling to the smoke detector connection socket, (f) insert the smoke detector into the retaining bracket.

An advantage of the present invention is that the smoke detector may be fitted to a large range of shapes and finishes of standard available fittings suited to any widely used flush-mounted ceiling light source. In addition to the advantage of an aesthetic appearance, a smoke detector according to the invention which becomes faulty may be rapidly demounted for inspection or repair and replaced if required.

The above describes only some embodiments of the present invention and modifications, obvious to those skilled in the art, can be made thereto without departing from the scope and spirit of the present invention.

The invention claimed is:

1. A smoke detector adapted for installation within a bracket of a ceiling downlight; all parts of said downlight other than a surrounding frame of said bracket projecting up into a hole cut into said ceiling; said downlight including a light source comprising an integral assembly of a generally parabolic reflector, a transparent lens, power connections and a globe; said light source adapted for releasable engagement with said mounting bracket; said smoke detector comprising:

a lower body portion adapted for engagement with said bracket, said lower body portion being of a generally truncated parabolic form closed at a wider lower end with a disc-shaped front face portion; and an upper body portion extending upwardly from said lower portion such that when said smoke detector is mounted in said bracket substantially all of said smoke detector projects up into said hole cut into said ceiling.

2. The smoke detector of claim 1 wherein said lower body portion is of similar shape to that of a light source adapted for retention in said bracket.

3. The smoke detector of claim 1 wherein said bracket is adapted for insertion into a hole cut into a ceiling.

4. The smoke detector of claim 2 wherein said bracket has a central aperture for receiving therein said light source.

5. The smoke detector of claim 2 wherein said smoke detector is retained in said bracket by a retaining arrangement adapted for securing said light source of said downlight within said bracket; said retaining arrangement securing said smoke detector when said bracket is used for mounting of said smoke detector instead of said downlight.

6. The smoke detector of claim 5 wherein said retaining arrangement comprises a retaining ring releasably held in said bracket; said front face portion of said smoke detector locating in said ring.

7. The smoke detector of claim 5 wherein said retaining arrangement comprises at least one spring clip.

8. The smoke detector of claim 1 wherein said upper body portion is of generally cylindrical shape with a diameter not exceeding the diameter of said front face portion.

9. The smoke detector of claim 1 wherein combined volume of said lower body portion and said upper body portion is sufficient to retain therein working components of said smoke detector.

10. The smoke detector of claim 1 wherein said front face portion is provided with at least one grille for ingress of air and smoke into said lower body portion.

11. The smoke detector of claim 1 wherein said front face portion is further provided with a reset/test button.

12. The smoke detector of claim 1 wherein said front face portion is further provided with an indicator light.

13. The smoke detector of claim 1 wherein said front face portion is of a substantially transparent material.

14. The smoke detector of claim 13 wherein said lower body portion is provided with a light emitter adapted to emit light through said substantially transparent material.

15. A smoke detector adapted for substantially flush fitting within an aperture in a ceiling; said detector comprising:

a detector body and a mounting bracket; said mounting bracket arranged to be of similar appearance to brackets of flush-mounted downlights and said smoke detector adapted to releasably engage with said bracket such that when said smoke detector is mounted in said bracket said smoke detector projects up into said aperture cut into said ceiling.

16. The smoke detector of claim 15 wherein said detector body is retained in said bracket so as to be wholly above a surface of said ceiling.

17. The smoke detector of claim 15 wherein said bracket is arranged for retained insertion into said aperture provided in said ceiling.

18. The smoke detector of claim 15 wherein said detector body and said bracket are provided with mating elements arranged to allow releasable retention of said detector body in said bracket.

19. A method for installing a smoke detector substantially flush with the surface of a ceiling; said smoke detector not projecting substantially below said surface; said method including the steps of:

(a) cutting a hole in a ceiling for insertion of a downlight bracket, (b) installing a power supply and any required interconnecting cabling, (c) installing said retaining bracket into said hole, (d) connecting said power supply and any said cabling to said smoke detector, (e) fitting said smoke detector to said bracket such that when said smoke detector is fitted to said bracket said smoke detector projects up into said hole cut into said ceiling.

20. The method of claim 19 wherein said smoke detector comprises a body having a lower portion shaped to conform to at least a portion of a light source intended for said bracket.

21. The method of claim 19 wherein said bracket is adapted to releasably retain said smoke detector within said bracket.

* * * * *